US008727709B2

(12) United States Patent
Bolgar

(10) Patent No.: US 8,727,709 B2
(45) Date of Patent: May 20, 2014

(54) CASING COMPONENT

(75) Inventor: Crispin D. Bolgar, Nottingham (GB)

(73) Assignee: Rolls-Royce PLC, London (GB)

( * ) Notice: Subject to any disclaimer, the term of this patent is extended or adjusted under 35 U.S.C. 154(b) by 854 days.

(21) Appl. No.: 12/862,102

(22) Filed: Aug. 24, 2010

(65) Prior Publication Data

US 2011/0076137 A1 Mar. 31, 2011

(30) Foreign Application Priority Data

Sep. 28, 2009 (GB) ..... 0916892.3

(51) Int. Cl.
*F01D 25/26* (2006.01)

(52) U.S. Cl.
USPC ..... 415/127; 415/134; 415/139

(58) Field of Classification Search
USPC ..... 415/30, 33, 126, 128, 134, 136, 137, 415/139, 127
See application file for complete search history.

(56) References Cited

U.S. PATENT DOCUMENTS

| | | | | |
|---|---|---|---|---|
| 3,227,418 A | | 1/1966 | West | |
| 3,520,635 A | * | 7/1970 | Ivanko et al. | 415/138 |
| 4,657,479 A | * | 4/1987 | Brown et al. | 415/138 |
| 4,714,404 A | * | 12/1987 | Lardellier | 415/127 |
| 2002/0071763 A1 | | 6/2002 | Brandl et al. | |
| 2008/0131270 A1 | * | 6/2008 | Paprotna et al. | 415/173.2 |

FOREIGN PATENT DOCUMENTS

| | | |
|---|---|---|
| DE | 10 2007 056 895 A1 | 5/2009 |
| EP | 1 475 516 A1 | 11/2004 |
| EP | 1 655 455 A1 | 5/2006 |
| EP | 1 746 256 A1 | 1/2007 |
| GB | 2 024 336 A | 1/1980 |
| GB | 2 068 470 A | 8/1981 |
| GB | 2 108 591 A | 5/1983 |
| GB | 2 129 880 A | 5/1984 |
| GB | 2 195 715 A | 4/1988 |
| GB | 2 371 093 A | 7/2002 |
| GB | 2 404 953 A | 2/2005 |

OTHER PUBLICATIONS

Great Britain Search Report dated Jan. 27, 2010 in Great Britain Application No. 0916892.3.
European Search Report issued in European Application No. 10 17 3787 dated Jan. 31, 2013.

* cited by examiner

*Primary Examiner* — Edward Look
*Assistant Examiner* — Jason Davis
(74) *Attorney, Agent, or Firm* — Oliff PLC

(57) ABSTRACT

A casing component (2) of a turbomachine, the casing component (2) comprising: a plurality of casing elements (14) which define a diameter of the casing component; and an actuation means operable to change the diameter of the casing component (2), wherein the actuation means changes the diameter of the casing component (2) as a function of a rotational speed of a rotatable component (4) disposed within the casing component (2).

13 Claims, 1 Drawing Sheet

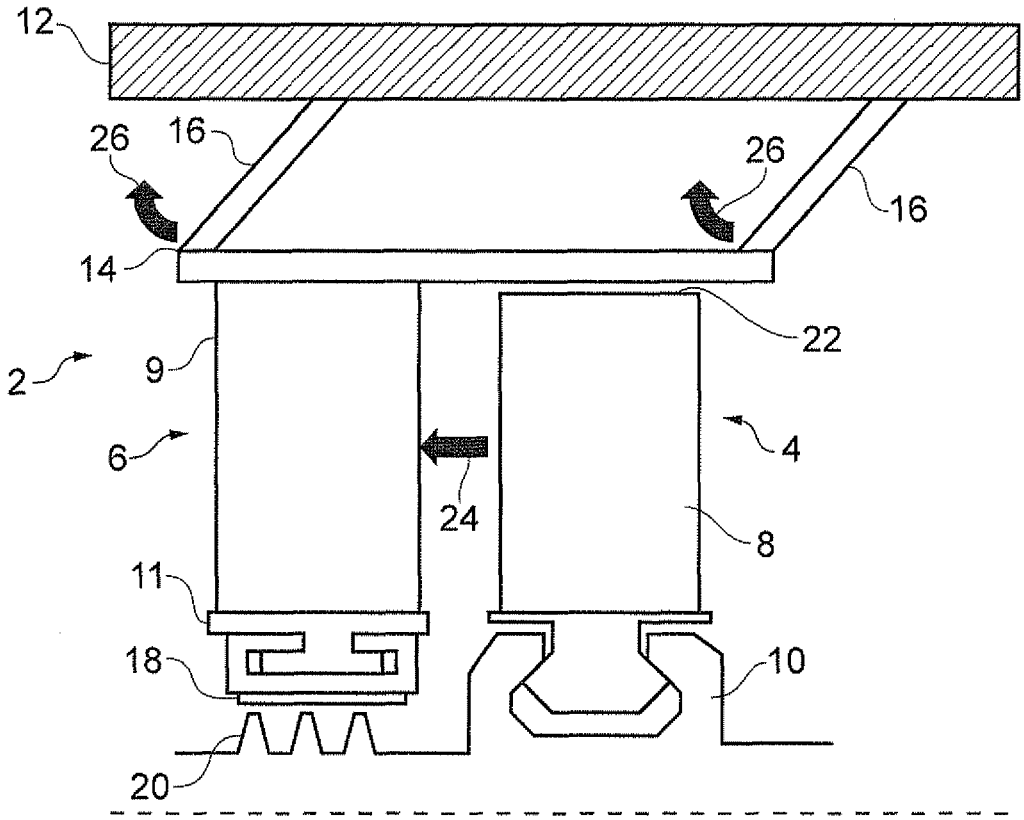
12
26
16
26
16
14
22
2
9
6
4
24
8
11
18
10
20

CASING COMPONENT

This invention relates to a casing component of a turbomachine comprising an actuation means for changing the diameter of the casing component, and particularly but not exclusively to a casing component having a fixed outer casing and a movable inner casing.

A turbomachine, for example a gas turbine engine, typically comprises a series of rotatable components, both in the compressor and turbine of the engine, which are housed within a fixed casing. The rotatable components each comprise an array of blades, each having an aerofoil cross section. The blades are attached to a central hub or drum. The blades of the rotatable components accelerate the air through the engine and/or extract energy from the air. Each of the rotatable components are coupled with a static component which comprises an array of vanes that are also of aerofoil cross section. The static components are connected to the radially inner and/or outer casing components.

The efficiency of the rotatable components is limited by the amount of air which passes over the aerofoil section blades. It is therefore essential to minimise air loss. This is achieved by ensuring the clearance between the radially outermost part of the blades (the blade's tip) and the radially outer casing component is as small as possible. However, the clearance must be sufficient so that the blade tips do not excessively contact the outer casing component during use.

The blade tip clearances may vary during use. This variation in clearance is controlled by three major factors, namely:

1) mechanical expansion or contraction of the drum and blades due to centrifugal loads;
2) thermal expansion or contraction of the drum and blades; and
3) thermal expansion or contraction of the casing components.

The effect of the centrifugal loads on the drum and blades is instantaneous with a change in speed of rotation of the rotatable components. In contrast, thermal expansion or contraction is not instantaneous and there is lag between a change in temperature and the expansion or contraction. Owing to their lower thermal mass, the thermal lag of the casing components is less than for the drum and blades.

The effect of the difference in response times is greatest during a re-slam manoeuvre, where the engine goes from full power to idle and then back to full power. Here a hot spinning drum is combined with cold casing components. Therefore the clearance between the blade tips and the outer casing component must be sufficient to avoid contact under these conditions. By providing sufficient clearance to allow for this condition, the air loss is increased and thus the efficiency of the engine is reduced.

The present invention addresses this problem so that the clearance may be reduced.

In accordance with a first aspect of the invention there is provided a casing component of a turbomachine, the casing component comprising: a plurality of casing elements which define a diameter of the casing component; and an actuation means operable to change the diameter of the casing component, wherein the actuation means changes the diameter of the casing component as a function of a rotational speed of a rotatable component disposed within the casing component.

The actuation means may change the diameter of the casing component as a function of the rotational speed of the rotatable component, such that a distance between a tip end of the rotatable component and the casing component is kept substantially constant.

The actuation means may change the diameter of the casing component as a function of the pressure applied to the actuation means by fluid flow through or over the casing component, such that a distance between a tip end of the rotatable component and the casing component is kept substantially constant.

The casing elements may comprise a fixed outer casing and a movable inner casing.

The diameter of the casing component may be defined by the movable inner casing of the casing elements.

The movable inner casing may be connected to the fixed outer casing by one or more legs.

The legs may be pivotally connected to the fixed outer casing and the movable inner casing.

The movable inner casing may be connected to the fixed outer casing by a parallel linkage.

The actuation means may comprise a static component which is attached to the movable inner casing.

Rotation of the rotatable component may create a substantially axial force on the static component.

The axial force may displace the static component which causes the movable inner casing to translate relative to the fixed outer casing.

The translation of the movable inner casing may have an axial as well as a radial component.

For a better understanding of the present invention, and to show more clearly how it may be carried into effect, reference will now be made, by way of example, to the accompanying drawing, in which:—

FIG. 1 shows a cross-section through a turbomachine having a casing component in accordance with an embodiment of the invention.

FIG. 1 shows a tubular casing component 2 in accordance with an embodiment of the invention. The casing component forms part of an axial compressor of known type. Disposed within the casing component is a rotatable component 4 (rotor) and a static component 6 (stator). The rotatable component 4 comprises a plurality of blades (only one shown, blade 8) connected to a hub 10, which rotate about an axial shaft (not shown). The static component 6 comprises a plurality of vanes (only one shown, vane 9) and an inner annulus 11. Both the blade 8 and vane 9 have an aerofoil cross-section. The compressor will typically comprise further stages of vanes and blades (not shown) disposed both upstream (leftwards) and downstream (rightwards) of the casing component 2, with the respective stages of blades also rotating about the same axial shaft.

The casing component 2 comprises a fixed outer casing 12 and a movable inner casing 14. The movable inner casing defines a diameter of the casing component 2. The movable inner casing 14 is attached to the fixed outer casing 12 via two legs 16 which are pivotably connected to both the fixed outer casing 12 and the movable inner casing 14. The fixed outer casing 12, movable inner casing 14 and two legs 16 form a four bar or parallel linkage which allows the movable inner casing 14 to translate relative to the fixed outer casing 12 whilst maintaining the two in substantially the same alignment. However, it should be appreciated that any number of legs could be used. For example a single leg may be sufficient, provided that it articulates so that the movable inner casing 14 and fixed outer casing 12 are maintained in substantially the same alignment (i.e. parallel to one another).

The inner annulus 11 of the static component 6 is formed in sections, each section being attached to a vane 9. Similarly, the movable inner casing 14 is formed in sections. The sections of both the inner annulus 11 of the static component 6 and the movable inner casing 14 are not directly connected to one another.

The static component 6 comprises a sealing element 18 which interfaces with a labyrinth seal 20 located on the shaft. The labyrinth seal 20 prevents air from passing between the static component 6 and the shaft. The static component 6 is attached to the movable inner casing 14 at an outer portion of the vane 9.

In use, the rotation of the rotatable component 4 creates a centrifugal load on the blade 8. This causes the length of the rotatable component 4 to increase, which would normally cause the clearance between a tip 22 of the blade 8 and the casing to reduce. However, the rotation of the rotatable component 4 (and particularly of the blade (not shown) immediately upstream of the stator 9) also leads to an increase in the static pressure difference between the upstream and downstream sides of the vane 9 of the static component 6 which creates an axial force, in the upstream direction, on the static component 6 (as shown by the arrow 24). Since the static component 6 is only attached to the movable inner casing 14, it is displaced away from the rotatable component 4 by the axial force, which causes the movable inner casing 14 to translate relative to the fixed outer casing 12. The four bar linkage formed by the legs 16 results in the translation of the static component 6 and movable inner casing 14 to have an axial and a radial component (as shown by the arrows 26). The movable inner casing 14 therefore translates closer to the fixed outer casing 12, so that the diameter defined by the movable inner casing 14 increases and the clearance between the tip 22 of the blade 8 and the movable inner casing 14 is maintained at a substantially constant distance. The radial translation is permitted since the movable inner casing 14 and inner annulus 11 are formed in sections. As a result of the radial translation, the distance between adjacent sections of both the movable inner casing 14 and inner annulus 11 increases. To prevent air loss between the adjacent sections, an expansion member may be provided which covers the gap between the sections. The expansion member may be housed within a cavity or recess spanning adjacent sections, so that when the distance between the adjacent sections increases the expansion member is exposed.

The casing component 2 may be calibrated to ensure that the increase in length of the rotatable component 4 for a given speed of rotation is equal to the radial component of the translation of the static component 6. This may be achieved by altering elements of the four bar linkage, such as: the length of the legs 16, the weight of the movable inner casing 14, the resistance of the pivotable connection between the legs 16 and the fixed outer casing 12 and movable inner casing 14, etc.

Of course, the radial translation of the movable inner casing 14 may be achieved via alternative means. For example the movable inner casing 14 may be attached to the fixed outer casing 12 by pneumatic or hydraulic actuators which causes direct translation of the movable inner casing 14 in a radial direction in response to a change in speed of the rotatable component 4.

The invention claimed is:

1. A casing component of a turbomachine, the casing component comprising:

a plurality of casing elements which define a diameter of the casing component; and an actuation means responsive to fluid flow and operable to change the diameter of the casing component, wherein the actuation means changes the diameter of the casing component as a function of a rotational speed of a rotatable component disposed within the casing component, an inner casing being substantially parallel with the outer casing as the diameter of the casing component increases.

2. The casing component as claimed in claim 1, wherein the actuation means changes the diameter of the casing component as a function of the rotational speed of the rotatable component, such that a distance between a tip end of the rotatable component and the casing component is kept substantially constant.

3. The casing component as claimed in claim 1, wherein the actuation means changes the diameter of the casing component as a function of the pressure applied to the actuation means by fluid flow through or over the casing component, such that a distance between a tip end of the rotatable component and the casing component is kept substantially constant.

4. The casing component as claimed in claim 1, wherein the casing elements comprise a fixed outer casing and a movable inner casing.

5. The casing component as claimed in claim 4, wherein the diameter of the casing component is defined by the movable inner casing of the casing elements.

6. The casing component as claimed in claim 4, wherein the movable inner casing is connected to the fixed outer casing by one or more legs.

7. The casing component as claimed in claim 6, wherein the legs are pivotally connected to the fixed outer casing and the movable inner casing.

8. The casing component as claimed in claim 4, wherein the movable inner casing is connected to the fixed outer casing by a parallel linkage.

9. The casing component as claimed in claim 4, wherein the actuation means comprises a static component which is attached to the movable inner casing.

10. The casing component as claimed in claim 9, wherein rotation of the rotatable component creates a substantially axial force on the static component.

11. The casing component as claimed in claim 10, wherein the axial force displaces the static component which causes the movable inner casing to translate relative to the fixed outer casing.

12. The casing component as claimed in claim 11, wherein the translation of the movable inner casing has an axial as well as a radial component.

13. A turbomachine comprising the casing component as claimed in claim 1.

* * * * *